US009394070B2

(12) United States Patent
Pearson et al.

(10) Patent No.: US 9,394,070 B2
(45) Date of Patent: Jul. 19, 2016

(54) PILL PACKAGING MACHINE

(71) Applicants: W Brent Pearson, Alexandria, LA (US); Yesudasan Sujith, Alexandria, LA (US)

(72) Inventors: W Brent Pearson, Alexandria, LA (US); Yesudasan Sujith, Alexandria, LA (US)

(73) Assignee: Pearson Medical Technologies, LLC, Alexandria, LA (US)

( * ) Notice: Subject to any disclaimer, the term of this patent is extended or adjusted under 35 U.S.C. 154(b) by 640 days.

(21) Appl. No.: 13/646,843

(22) Filed: Oct. 8, 2012

(65) Prior Publication Data

US 2014/0096479 A1 Apr. 10, 2014

(51) Int. Cl.

| | |
|---|---|
| ***B65B 61/26*** | (2006.01) |
| ***B65B 39/00*** | (2006.01) |
| ***B65B 35/12*** | (2006.01) |
| ***B65B 35/56*** | (2006.01) |
| ***B65B 5/10*** | (2006.01) |
| ***B65B 57/14*** | (2006.01) |
| ***B65B 1/10*** | (2006.01) |

(Continued)

(52) U.S. Cl.

CPC . *B65B 61/26* (2013.01); *B65B 1/10* (2013.01); *B65B 5/103* (2013.01); *B65B 9/02* (2013.01); *B65B 35/12* (2013.01); *B65B 35/56* (2013.01); *B65B 39/007* (2013.01); *B65B 57/14* (2013.01); *B65B 61/02* (2013.01)

(58) Field of Classification Search

CPC ..... B65B 5/045; B65B 5/103; B65B 57/14; B65B 57/10; B65B 57/12; B65B 39/007; B65B 35/12; B65B 9/045; B65B 9/02; B65B 35/56; B65B 61/26; F42B 33/002; A61J 7/02

USPC ..... 53/493, 498, 500, 73, 74, 131.5, 553, 53/554, 235, 246

See application file for complete search history.

(56) References Cited

U.S. PATENT DOCUMENTS 2,421,916 A * 6/1947 Underwood ..... 193/45
2,661,881 A * 12/1953 Kasper ..... 53/67

(Continued)

FOREIGN PATENT DOCUMENTS

CA 2467628 A1 9/2009
CA 2792030 A1 4/2014
WO WO 2011109861 A1 * 9/2011 ..... B65B 39/007

OTHER PUBLICATIONS

PCT Application No. US2014/067341; Written Opinion of the International Searching Authority for Applicant Pearson Medical Technologies, LLC dated Feb. 25, 2015, 9 pages.

(Continued)

*Primary Examiner* — Stephen F Gerrity
(74) *Attorney, Agent, or Firm* — Jones Walker LLP

(57) ABSTRACT

A system for packaging unit doses of medication. One pill packaging system comprises a feeding assembly, a pill packaging assembly, and a pill guide. The pill guide may be positioned between the feeding assembly and packaging assembly and comprise a body having inlet and outlet apertures, whereby a pill traveling through the pill guide exits the outlet aperture oriented such that a leading edge of the pill points toward one side of the pill package and the trailing edge of the pill is inclined toward an opposite side of the pill package. Another pill packaging system comprises a pill feeding assembly comprising a pill disk with circumferentially positioned pill slots, a pill packaging assembly, and a sensor, such as a camera, to determine whether more than one pill is positioned in a pill slot on the pill disk.

9 Claims, 11 Drawing Sheets

(51) Int. Cl.
*B65B 9/02* (2006.01)
*B65B 61/02* (2006.01)

(56) References Cited

U.S. PATENT DOCUMENTS

| | | | | | |
|---|---|---|---|---|---|
| 2,718,342 | A | * | 9/1955 | Anderson | 53/246 |
| 2,828,888 | A | * | 4/1958 | Nicolle | 221/263 |
| 2,934,869 | A | * | 5/1960 | Engleson et al. | 53/57 |
| 2,943,428 | A | * | 7/1960 | Stroop | 53/493 |
| 3,133,623 | A | * | 5/1964 | Collins et al. | 198/432 |
| 3,397,505 | A | * | 8/1968 | Critchell | 53/74 |
| 3,406,869 | A | | 10/1968 | Cordova | |
| 3,545,164 | A | * | 12/1970 | Middleton | 53/446 |
| 3,628,694 | A | * | 12/1971 | Nichols | 221/265 |
| 3,775,941 | A | * | 12/1973 | Bross | 53/246 |
| 3,783,986 | A | | 1/1974 | Bolen | |
| 3,789,575 | A | * | 2/1974 | Bross | 53/534 |
| 3,796,346 | A | | 3/1974 | Ribouleau | |
| 3,999,690 | A | | 12/1976 | Deckler | |
| 4,018,358 | A | | 4/1977 | Johnson et al. | |
| 4,493,178 | A | * | 1/1985 | Buckner et al. | 53/131.5 |
| 4,577,451 | A | * | 3/1986 | Salicini | 53/58 |
| 4,627,225 | A | * | 12/1986 | Faller et al. | 53/510 |
| 4,655,026 | A | * | 4/1987 | Wigoda | 53/55 |
| 4,680,464 | A | * | 7/1987 | Bross | 250/223 R |
| 4,697,721 | A | | 10/1987 | Johnson et al. | |
| 4,915,258 | A | | 4/1990 | Olson | |
| 5,555,707 | A | * | 9/1996 | Schwenger | 53/493 |
| 5,682,733 | A | * | 11/1997 | Perrone | 53/560 |
| 5,737,902 | A | * | 4/1998 | Aylward | 53/475 |
| 5,799,468 | A | * | 9/1998 | Eck et al. | 53/453 |
| 5,831,197 | A | * | 11/1998 | Bill et al. | 86/23 |
| 5,963,453 | A | * | 10/1999 | East | 700/244 |
| 6,085,938 | A | | 7/2000 | Coughlin | |
| 6,115,990 | A | * | 9/2000 | Vogelsanger | 53/53 |
| 6,289,656 | B1 | * | 9/2001 | Wangu et al. | 53/507 |
| 6,345,487 | B1 | * | 2/2002 | Luciano et al. | 53/54 |
| 6,378,572 | B1 | * | 4/2002 | Neubauer et al. | 141/94 |
| 6,497,083 | B1 | * | 12/2002 | Garwood et al. | 53/244 |
| 6,519,914 | B1 | * | 2/2003 | Pesho | 53/134.1 |
| 6,561,377 | B1 | * | 5/2003 | Pearson et al. | 221/7 |
| 6,997,341 | B2 | * | 2/2006 | Pearson et al. | 221/7 |
| 7,097,068 | B2 | | 8/2006 | Limback et al. | |
| 7,392,640 | B2 | * | 7/2008 | Vasquali | 53/498 |
| 7,795,556 | B1 | * | 9/2010 | Dean | 209/580 |
| 2002/0014053 | A1 | * | 2/2002 | Kim | 53/154 |
| 2002/0092275 | A1 | * | 7/2002 | Kim | 53/493 |
| 2002/0096535 | A1 | * | 7/2002 | Zhang et al. | 221/258 |
| 2003/0111484 | A1 | | 6/2003 | Pearson et al. | |
| 2004/0011806 | A1 | * | 1/2004 | Luciano et al. | 221/266 |
| 2004/0035878 | A1 | * | 2/2004 | Aylward | 221/303 |
| 2004/0111277 | A1 | * | 6/2004 | Pearson et al. | 705/1 |
| 2004/0128955 | A1 | * | 7/2004 | Aylward | 53/473 |
| 2006/0273106 | A1 | * | 12/2006 | Kim | 221/200 |
| 2010/0077708 | A1 | * | 4/2010 | Kobayashi et al. | 53/501 |
| 2010/0139222 | A1 | * | 6/2010 | Federle et al. | 53/474 |
| 2010/0175352 | A1 | * | 7/2010 | Soloman | 53/508 |
| 2011/0113727 | A1 | * | 5/2011 | Bonner | 53/266.1 |
| 2011/0126495 | A1 | * | 6/2011 | Tampieri et al. | 53/447 |

OTHER PUBLICATIONS

U.S. Appl. No. 14/094,384 (Pill Counting and Conveying Apparatus)—Examiner's Non-Final Action dated Mar. 26, 2015, 10 pages.

U.S. Appl. No. 14/094,384 (Pill Counting and Conveying Apparatus)—Applicant's Response to Non-Final Action dated Sep. 28, 2015, 11 pages.

U.S. Appl. No. 14/094,384 (Pill Counting and Conveying Apparatus)—Examiner's Final Action dated Jan. 4, 2016, 10 pages.

* cited by examiner

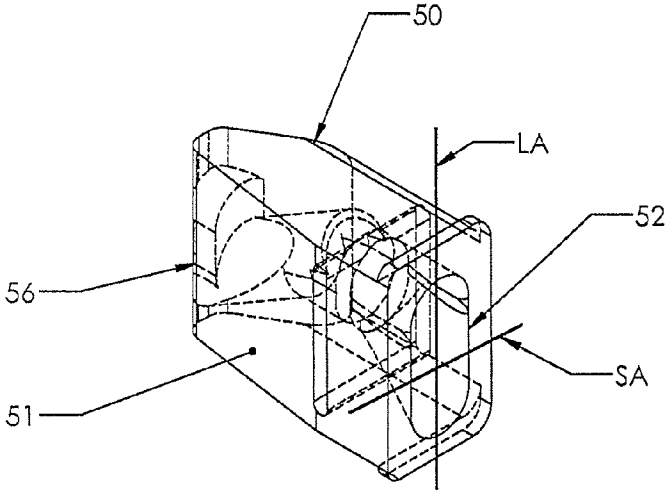
FIG. 4A
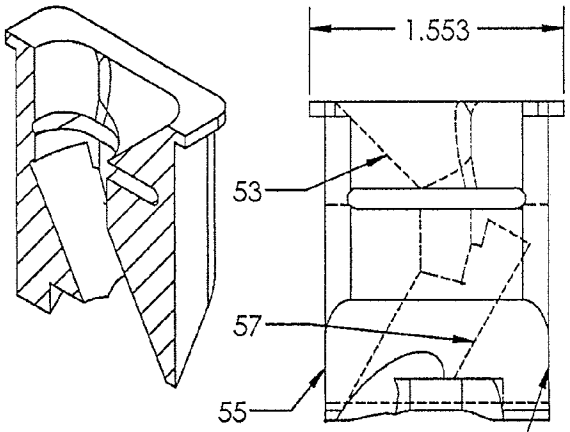
FIG. 4B
FIG. 4C
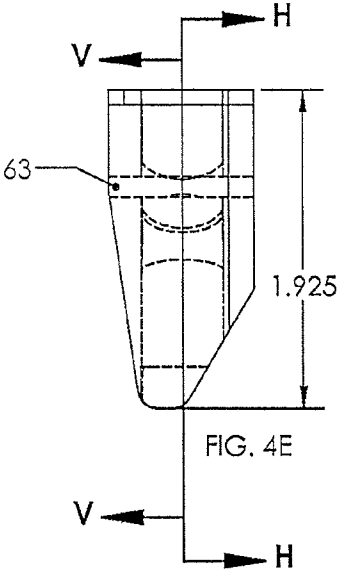
FIG. 4E
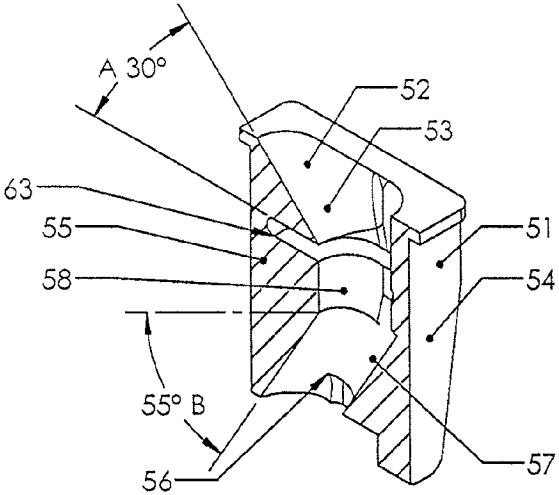
FIG. 4D

PILL PACKAGING MACHINE

BACKGROUND OF INVENTION

The present invention relates to machines for packaging unit doses of medication. There are many instances in pharmacies, hospitals, and other healthcare facilities where it is desired to individually package unit doses of certain medications. This is usually accomplished by placing the medication (normally in pill, tablet or capsule form and hereinafter the term "pill" shall mean any of tablet, capsule, caplet, geltab, gelcaps, and other forms of oral solid medication) in packaging such as a strip packages. Packaging machines such as the Euclid Cadet (also see U.S. Pat. No. 4,493,178 which is incorporated by reference herein) are presently employed to place unit doses of medication into individual packages. These types of packaging devices typically employ two lengths of coated paper (or plastic film) which are supplied by rolls and may be referred to as dual film fed packaging machines. A pill feeder is positioned above the film and deposits the pill between the two lengths of film. A pair of heated sealing jaws will engage the sections of film where a pill has been deposited and will melt a seal around the perimeter of the film in order to form individual packages enclosing the pills. Each package is then typically either cut off from the two rolls of film into separate packages or formed into long strips of packages which are perforated between each package for later separation by a healthcare provider. The ongoing operation of the packaging process will form multiple individual packages or a long string of perforated "strip packages."

Typically, one side of the strip packages will normally be formed of a transparent plastic film such that the pills may be seen. The other side of the strip packages will be formed of a material which may be printed upon and a color (e.g. white) which will contrast well with printing ink. Typically, important information regarding the drug being packaged is printed on the nontransparent side of the individual packages by a printer incorporated into the packaging machine. This information might include the name of the drug, the dose, the expiration date of the drug, and a bar code representing the National Drug Code (NDC) number.

SUMMARY OF SELECTED EMBODIMENTS

One embodiment of a pill packaging system comprises a feeding assembly, a pill packaging assembly, and a pill guide. The pill guide may be positioned between the feeding assembly and packaging assembly and comprise a body having inlet and outlet apertures, with a rear portion of the outlet aperture extending further downward than the front portion of the outlet aperture, whereby a pill traveling through the pill guide exits the outlet aperture oriented such that a leading edge of the pill points toward one side of the pill package and the trailing edge of the pill is inclined toward an opposite side of the pill package.

Alternatively, the pill guide may include a detection window. Such a system may further comprise a sensor positioned to detect a pill passing through a plane of the window and a controller causing the pill feeding assembly to dispense a next pill or not dispense the next pill based upon whether the sensor detects a pill crossing the plane of the window.

Another embodiment of a pill packaging system comprises a pill feeding assembly comprising a pill disk with circumferentially positioned pill slots, a pill packaging assembly, and a camera viewing the pill disk and sending images to a controller, which analyzes the images based on predetermined criteria to determine whether more than one pill is positioned in a pill slot on the pill disk.

Yet another embodiment of a pill packaging system comprises a pill packaging assembly including two lengths of packaging film fed through a set of sealing jaws by a film advancing mechanism, a controller, a database, and an input device for receiving information identifying a pill type. Instead of a database and input device, the system may alternatively employ a camera in communication with a controller programmed to operate the film advancement mechanism to pull a length of film corresponding to a pill's measurements or stop packaging operations.

In a first embodiment, a pill packaging system comprises: a. a pill feeding assembly; b. a pill packaging assembly positioning individual pill packages to receive a pill; c. a pill guide positioned between the feeding assembly and packaging assembly, the pill guide comprising: i. a body having an inlet aperture in an upper end of the body and an elongated outlet aperture on a lower end of the body, the outlet aperture having a front and rear portion; ii. an outlet inclined surface sloping toward the rear of the body and transitioning to the outlet aperture; and iii. the rear portion of the outlet aperture extending further downward than the front portion of the outlet aperture, whereby a pill traveling through the pill guide exits the outlet aperture oriented such that a leading edge of the pill points toward one side of the pill package and the trailing edge of the pill is inclined toward an opposite side of the pill package.

The pill packaging system according to the first embodiment, wherein the outlet aperture is positioned more to the rear portion of the outlet aperture than the front portion.

The pill packaging system according to the first embodiment, wherein the pill body includes an inlet inclined surface sloping from the inlet aperture toward the front portion of the body. Additionally, wherein the inlet inclined surface has a slope of between about 35° and about 55° relative to a plane containing said inlet.

The pill packaging system according to the first embodiment, wherein the outlet inclined surface has a slope of between about 40° and about 75° relative to a plane containing said inlet.

The pill packaging system according to the first embodiment, wherein the elongated inlet has a long axis of between about 50 mm and about 10 mm and a short axis of between about 20 mm and about 5 mm.

The pill packaging system according to the first embodiment, wherein the outlet has a long axis of between about 50 mm and about 10 mm and a short axis of between about 20 mm and about 5 mm.

The pill packaging system according to the first embodiment, wherein a length of the outlet inclined surface is greater than a length of the inlet inclined surface.

The pill packaging system according to the first embodiment, wherein the length of the outlet inclined surface is between about 22 mm and about 28 mm and the length of the inlet inclined surface is between about 16 mm and about 22 mm.

The pill packaging system according to the first embodiment, wherein a visual detection window is formed in the pill guide body.

The pill packaging system according to the first embodiment, wherein the pill guide body has a length of between about 25 mm and about 100 mm. Additionally, wherein the pill guide body has a length of about 50 mm.

The pill packaging system according to the first embodiment, wherein the pill feeding assembly comprises a pill disk having a series of circumferentially positioned pill slots.

The pill packaging system according to the first embodiment, wherein the system further includes a printer to print label information on a pill package formed by the system. Additionally, wherein the pill packaging assembly includes a bar code scanner positioned to read the bar code on the pill package after the pill package has been formed by the sealing jaws.

In a second embodiment, a pill packaging system comprises: a. a pill feeding assembly comprising a pill disk having a series of circumferentially positioned pill slots; b. a pill packaging assembly; c. a camera which is positioned to view the pill disk and capable of sending images to a controller; and d. the controller capable of analyzing images from a camera based on predetermined criteria to determine whether more than one pill is positioned in a pill slot on the pill disk.

The pill packaging system according to the second embodiment, wherein (i) the database of pill information contains vision-related information corresponding to a pill type being packaged; (ii) the controller compares at least one image of the actual pill being packaged taken by a camera associated with the system to vision-related information in the database; (iii) the controller verifies that the pill being actually being packaged corresponds to the pill type from the database.

In a third embodiment, a pill packaging system comprises: a. a pill feeding assembly; b. a pill packaging assembly; c. a pill guide positioned between the feeding assembly and packaging assembly, the pill guide including a detection window formed therein; d. a sensor positioned to detect a pill passing through a plane of the window; e. a controller causing the pill feeding assembly to dispense a next pill or not dispense the next pill based upon whether the sensor detects a pill crossing the plane of the window.

The pill packaging system according to the third embodiment, wherein the sensor is either through beam sensor or a reflected beam sensor.

The pill packaging system according to the third embodiment, wherein the pill feeding assembly includes a pill disk with pill slots positioned circumferentially around the disk. Additionally, wherein if the controller detects a pill passing through the pill guide, the controller causes the pill packaging assembly to advance the next package and causes the pill disk to advance to the next pill slot. Or alternatively, wherein a camera is position to view the pill disk and the controller analyzes at least one image from the camera to determine whether more than one pill is positioned in a pill slot on the pill disk.

The pill packaging system according to the third embodiment, wherein the system further includes a printer to print label information on a pill package formed by the system. Additionally, wherein the controller communicates with a database of pill information and the controller directs at least a portion of the pill information related to a pill being packaged to be printed on the pill package. Additionally, wherein (i) the database of pill information contains vision-related information corresponding to a pill type being packaged; (ii) the controller compares at least one image of the actual pill being packaged taken by a camera associated with the system to vision-related information in the database; (iii) the controller verifies that the pill actually being packaged corresponds to the pill type from the database. Additionally, wherein the vision-related information includes a visual image of the pill type being packaged.

In a fourth embodiment, a pill packaging system comprises: a. a pill packaging assembly including two lengths of packaging film fed through a set of sealing jaws and a film advancing mechanism pulling the lengths though the sealing jaws; b. a controller controlling the film advancement mechanism and the sealing jaws; c. a database associating a pill type with a desired size of a pill package; d. an input device for receiving information identifying a pill type; and e. wherein said controller is programmed to operate the film advancement mechanism to pull a length of film corresponding to a pill package size associated with the pill type.

The pill packaging system according to the fourth embodiment, wherein the pill packaging assembly includes a printer capable of printing a bar code on the film.

The pill packaging system according to the fourth embodiment, wherein at least one jaw from the set of sealing jaws is heated and seals the two lengths of film along three sides to form a rectangular pill package.

The pill packaging system according to the fourth embodiment, wherein the database associates a package size with a National Drug Code number for a particular pill.

The pill packaging system according to the fourth embodiment, wherein the input device is at least one of a bar code scanner, a touch screen, a keypad, or a voice recognition input.

The pill packaging system according to the fourth embodiment, wherein the pill type is determined from numerical information located on a pill supply container.

The pill packaging system according to the fourth embodiment, wherein packaging assembly includes a printer printing pill identification information on at least one of the lengths of film forming a package. Additionally, wherein the pill identification information includes a bar code.

Additionally, wherein the pill packaging assembly includes a bar code scanner positioned to read the bar code on the pill package after the pill package has been formed by the sealing jaws. And additionally, wherein upon detection of an unreadable bar code, the controller ceases operation of the packaging system and generates an error message for an operator. Or alternatively, wherein upon detection of an unreadable bar code, the controller generates a message for an operator specifying the packages with non-readable bar codes. Or alternatively, wherein the pill packaging assembly includes a marker device which marks a pill package when the bar code scanner cannot read the bare code on the pill package. Additionally, wherein marking device applies a dye, paint, or ink to the package.

The pill packaging system according to the fourth embodiment, wherein the film advancing mechanism includes a pinch motor.

In a fifth embodiment, a pill packaging system comprises: a. a pill feeding assembly; b. a pill packaging assembly including two lengths of packaging film fed through a set of sealing jaws and a film advancing mechanism pulling the lengths though the sealing jaws; c. a controller controlling the film advancement mechanism and the sealing jaws; d. a camera which is positioned to measure the pill being packaged and can communicate those measurements to a controller; and e. wherein said controller is programmed to operate the film advancement mechanism to pull a length of film corresponding to a pill's measurements or stop packaging operations.

In a sixth embodiment, a pill packaging system comprises: a. a pill feeding assembly wherein the wherein the feeding assembly includes a pill disk with pill slots positioned circumferentially around the disk; b. a pill packaging assembly including two lengths of packaging film fed through a set of sealing jaws and a film advancing mechanism pulling the lengths though the sealing jaws; c. a controller controlling the film advancement mechanism and the sealing jaws and which communicates with a database of pill information; and d. a camera which is positioned to capture an image of the pill being packaged and can communicate that image to the controller.

The pill packaging system according to the sixth embodiment, wherein (i) the controller database of pill information contains vision-related information corresponding to a pill type being packaged; (ii) the controller compares at least one image of the actual pill being packaged taken by a camera associated with the system to vision-related information in the database; and (iii) the controller verifies that the pill being actually being packaged corresponds to the pill type from the database.

BRIEF DESCRIPTION OF THE DRAWINGS

FIGS. 4A to 4E are different views of one embodiment of a pill guide used in the present invention.

DETAILED DESCRIPTION OF SELECTED EMBODIMENTS

Figure 2A:
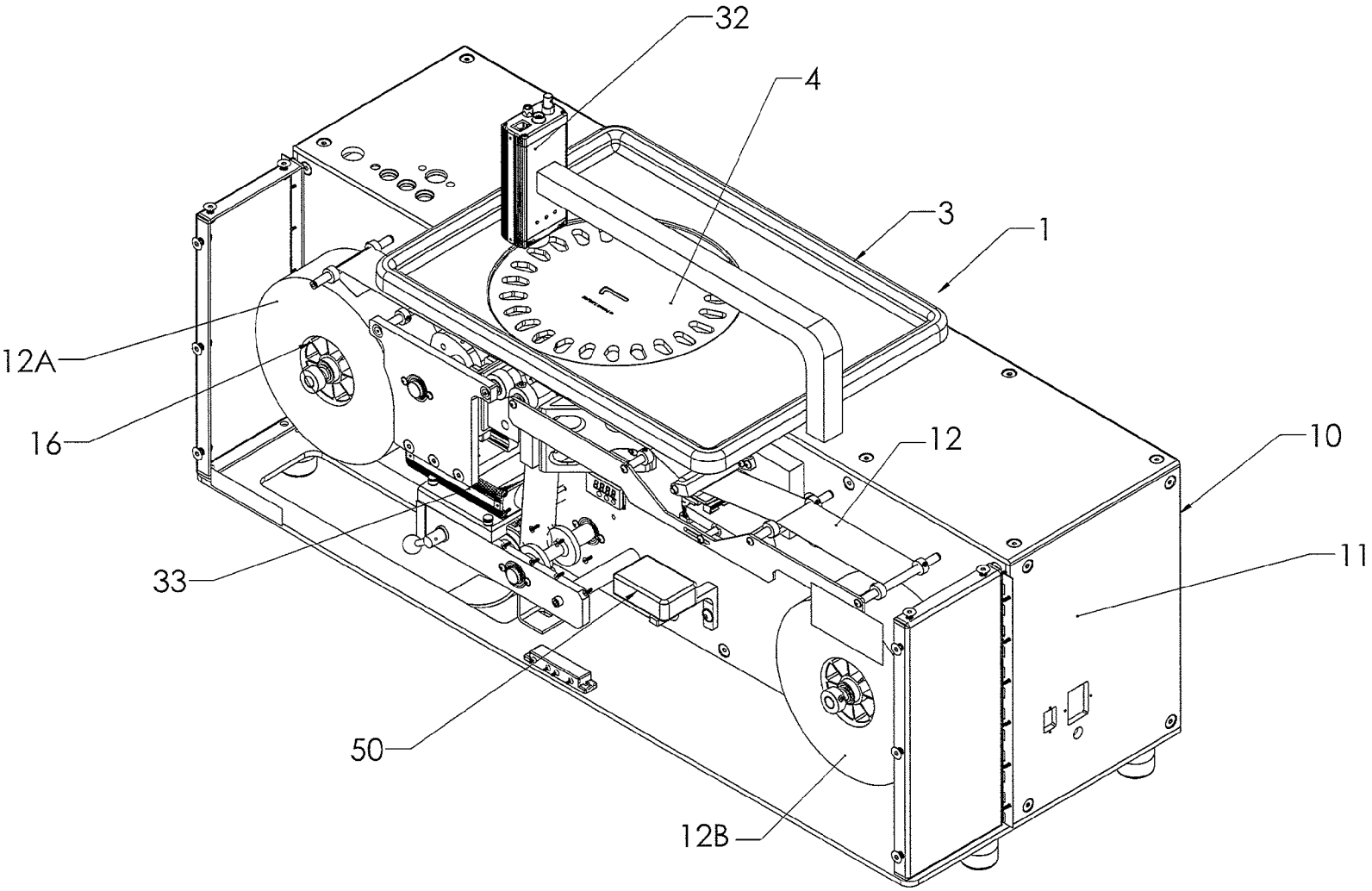
FIG. 2A is perspective view of the pill packaging system embodiment of FIG. 1.

One embodiment of the pill packaging system of the present invention is illustrated in FIG. 2A. The pill packaging system 1 most generally comprises the pill feeding assembly 3 and the pill packaging assembly 10 positioned below pill feeding assembly 3. Pill feeding assembly 3 is perhaps best understood viewing the sectional illustration of FIG. 3A. Pill feeding assembly 3 rests upon the upper housing cover 19 of pill packaging assembly housing 11. Pill feeding assembly 3 generally includes pill tray 7 having raised borders 8 and a center aperture to accommodate pill disk (or pill guide wheel) 4. Pill disk 4 has a series of pills apertures 5 formed along the circumference of the disk. One example of such a pill disk 4 is seen in U.S. Pat. No. 7,650,732, issued Jan. 26, 2010, which is incorporated by reference herein in its entirety.

Figure 3B:
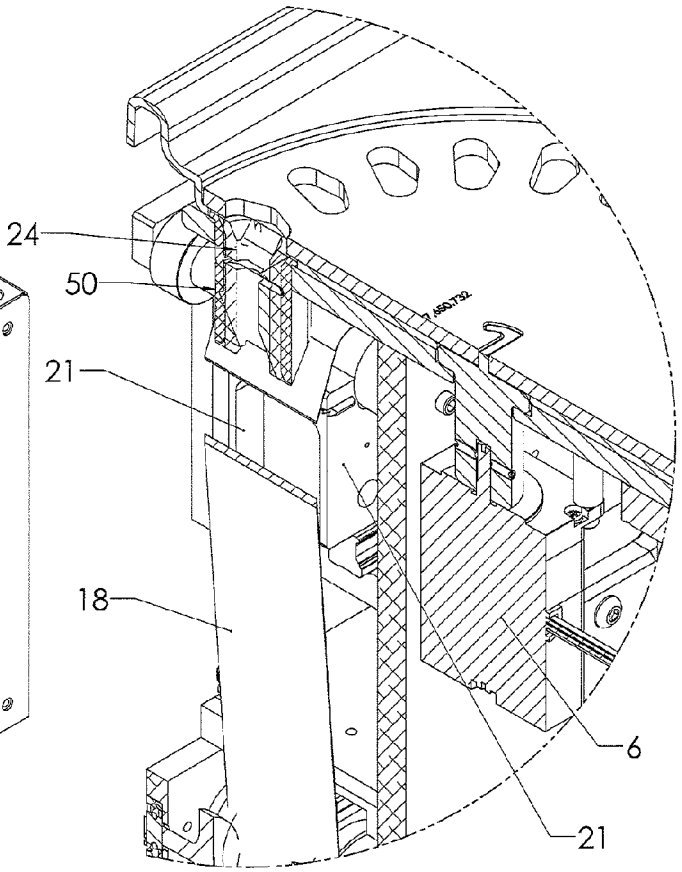
FIG. 3B an enlarged perspective view of the primary components seen in FIG. 3A.
Figure 3A:
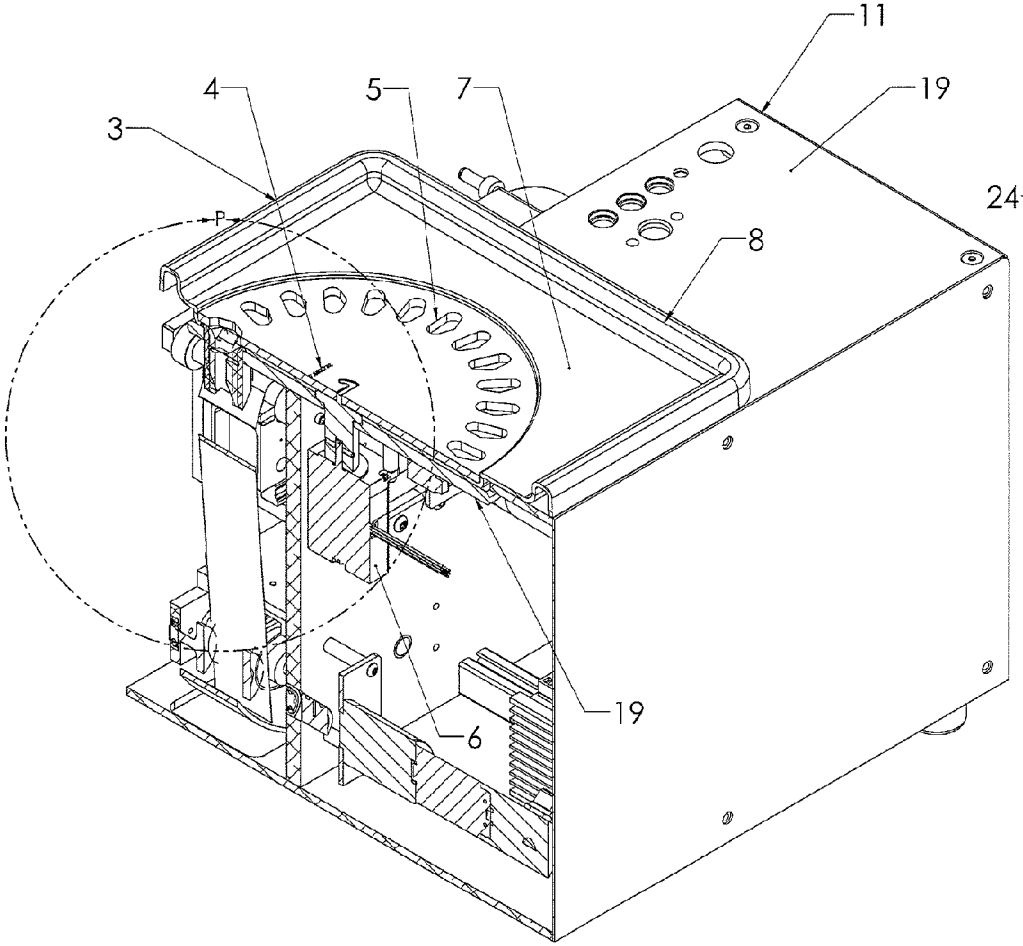
FIG. 3A is a perspective cross-section view of the pill packaging system embodiment of FIG. 1.

As suggested in FIG. 3B, a shaft of the indexing motor 6 extends through upper housing cover 19 and is keyed to engage pill disk 4. It can be understood how indexing motor 6 will rotate pill disk 4 and successively bring each of the pill apertures 5 into alignment with another aperture 24 formed in housing cover 19 and deposit a pill in the pill guide 50, as will be explain in greater detail below. Although one particular type of pill disk 4 is shown in the Figures, it will be understood that many different pill disks could be employed in the present invention. Nor is pill feeding assembly 3 limited to pill feeding device which have a pill disk, but could be any conventional or future developed pill feeding device which can operate with other elements of the invention described herein, two nonlimiting examples of which are the pill feeders as described in U.S. Pat. Nos. 6,561,377 and 6,997,341.

Figure 2B:
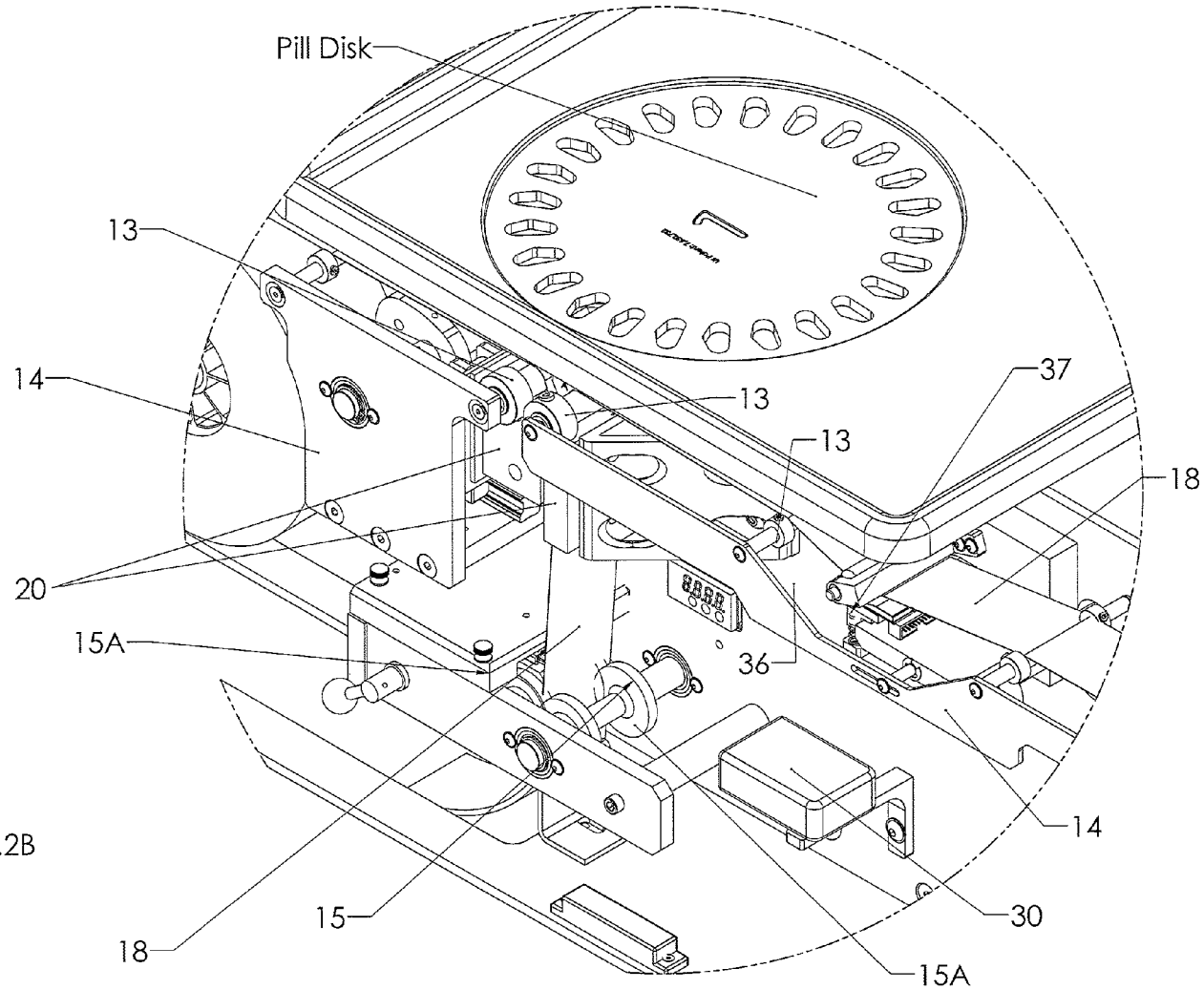
FIG. 2B is an enlarged perspective view of the primary components seen in FIG. 2A.

Positioned below pill feeding assembly 3 as seen in FIG. 2A is the pill packaging assembly 10. The embodiment of pill packaging assembly 10 seen in the Figures is a two-film packaging machine. Two rolls of packaging film 12A and 12B are positioned on opposing sides of the packaging assembly 10. As more clearly seen in FIG. 2B, a series of roller frame members 14 secure various rollers within the housing 11 of the packaging assembly 10. In FIG. 2B, a packaging film 18 extends from each of the film rollers across a series of guide rollers 13, past sealing jaws 20, and then downward to be engaged by pinch rollers 15. Pinch rollers 15 will grip the two segments of film (now formed into packages by heating jaws 20) and pull the film segments 18 from the film rolls 12A and 12B and through the packaging assembly 10. Although not explicitly shown in the Figures, it will be understood that a pinch motor imparts rotation to pinch rollers 15 and control of the pinch motor allows for control of the film 18 being drawn through the packaging machine 10. In one example, the film from roll 12A is a transparent, cellophane based film and film from roll 12B is paper foil film capable of accepting printed characters from a conventional printer. Both films are conventionally available from suppliers such as Pharmacy Automation Supplies of Chicago, Ill.

Figure 1A:
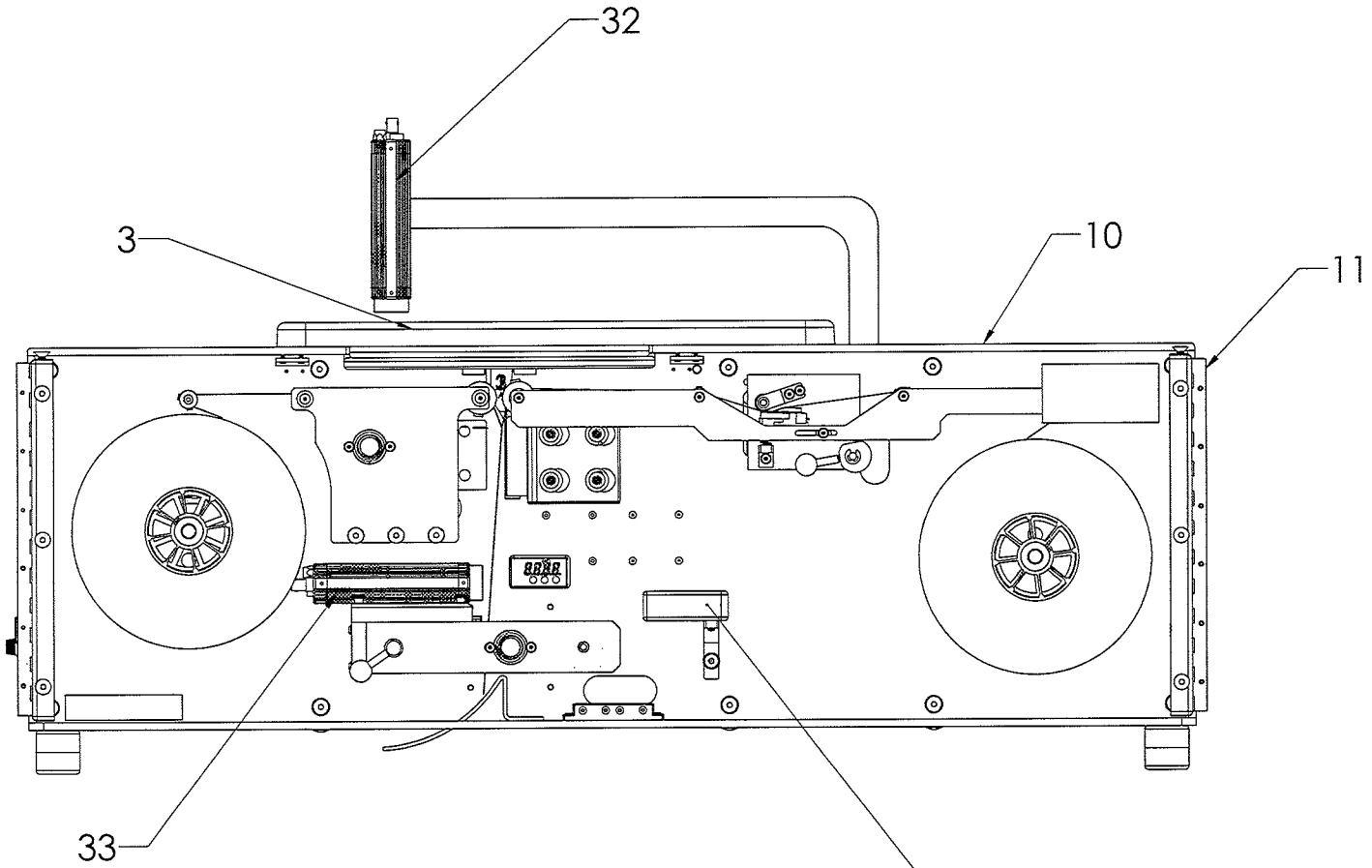
FIG. 1A is a front planer view of one embodiment of the pill packaging system of the present invention.
Figure 1B:
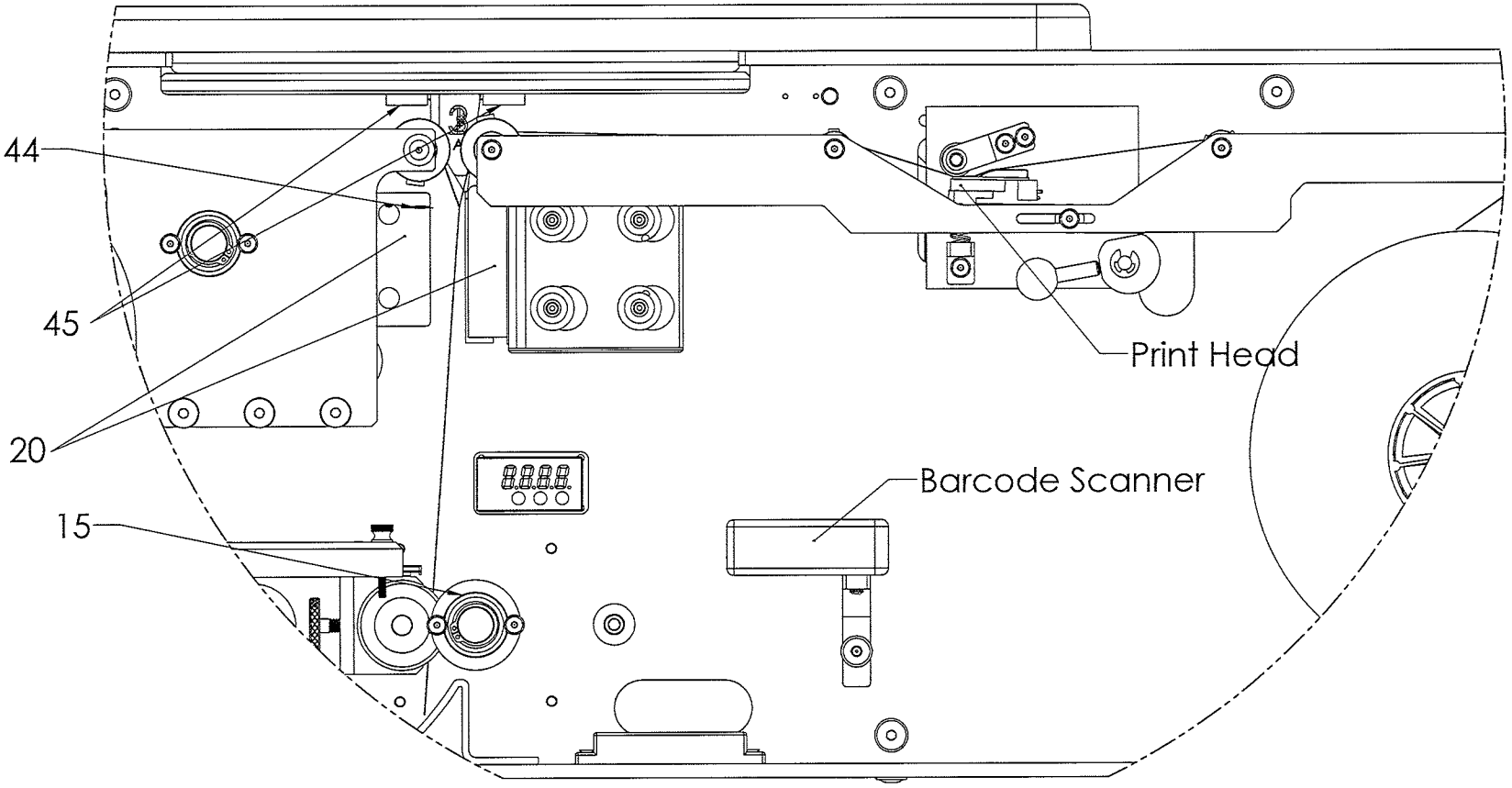
FIG. 1B is an enlarged view of the primary components seen in FIG. 1A.
Figures 2C, 2D:
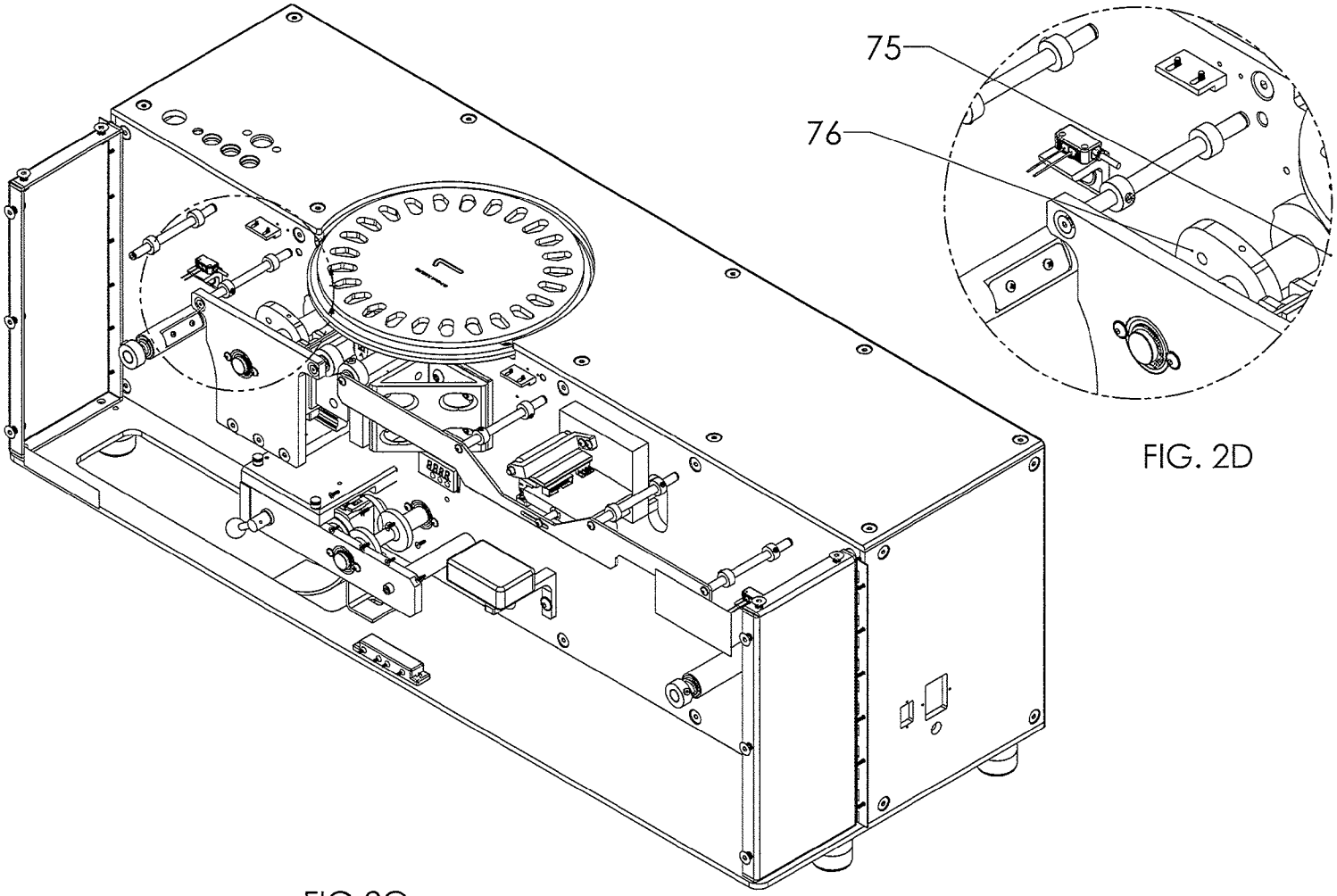
FIG. 2C is a slightly modified perspective view from that seen in FIG. 2A.
FIG. 2D is an enlarged section of the area circled in FIG. 2C.
Figure 3C:
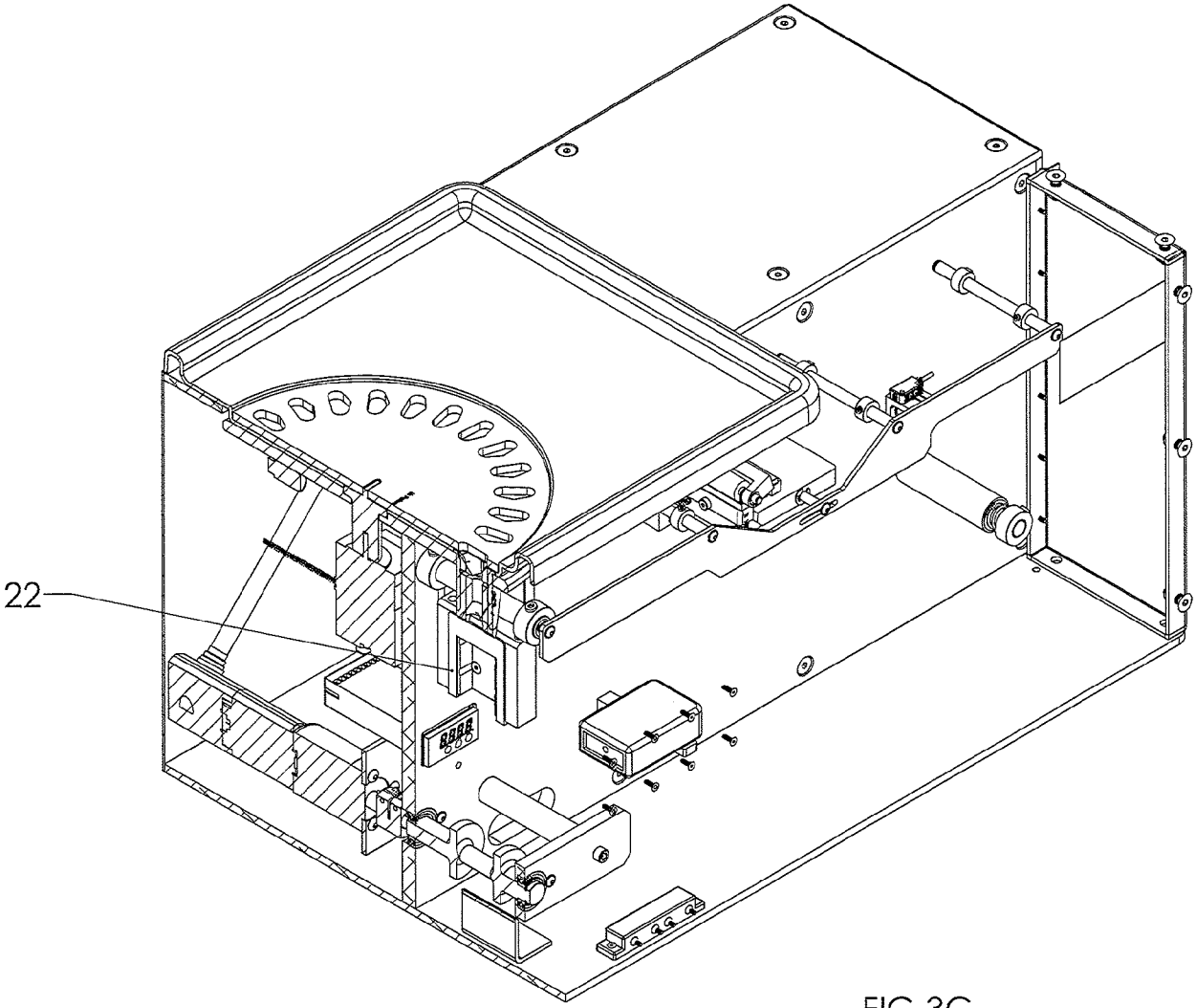
FIG. 3C is a perspective cross-sectional view opposing that seen in FIG. 3A.

The major components of sealing jaws 20 are best seen in FIGS. 3B and 3C. In FIG. 3B, a portion of film 18 is shown removed to illustrate left U-shaped jaw member 21. FIG. 3C suggests how the right U-shaped jaw member 22 opposes the left U-shaped jaw member 21 and it will be understood that when the two jaw members come together, the two film segments 18 will be pressed together between the jaw members. In the embodiment illustrated, left U-shaped jaw member 21 is connected to a heating source which raises jaw member 21 to a temperature sufficient to melt together and seal the two film segments 18. FIG. 2C illustrates a seal jaw cam 76 which pushes the left U-shaped seal jaw 21 to move toward the right U-shaped seal jaw 22 until the seal jaw cam 76 reaches its maximum extension, at which point the two packaging films are pressed together and make a seal along the path of the U-shaped seal jaws to create a single package. A motor (not shown) applies torque to operate the seal jaw cam 76. A seal motor cam 75 may be oriented to rotate with the seal jaw cam 76. Rotation of seal motor cam 75 will trigger a switch (not shown) which allows the system software identify the left U-shaped seal jaw 21 position and to initiate certain actions such as starting the index motor 6 and triggering the bar code scanner 30. Additionally, FIG. 1B illustrates how a perforation blade 44 may be positioned on one of the sealing jaws 20. When the jaws engage, perforation blade 44 will cut a series of perforations in the film, thereby forming a tear line for easier separation of individual packages.

Figure 5:
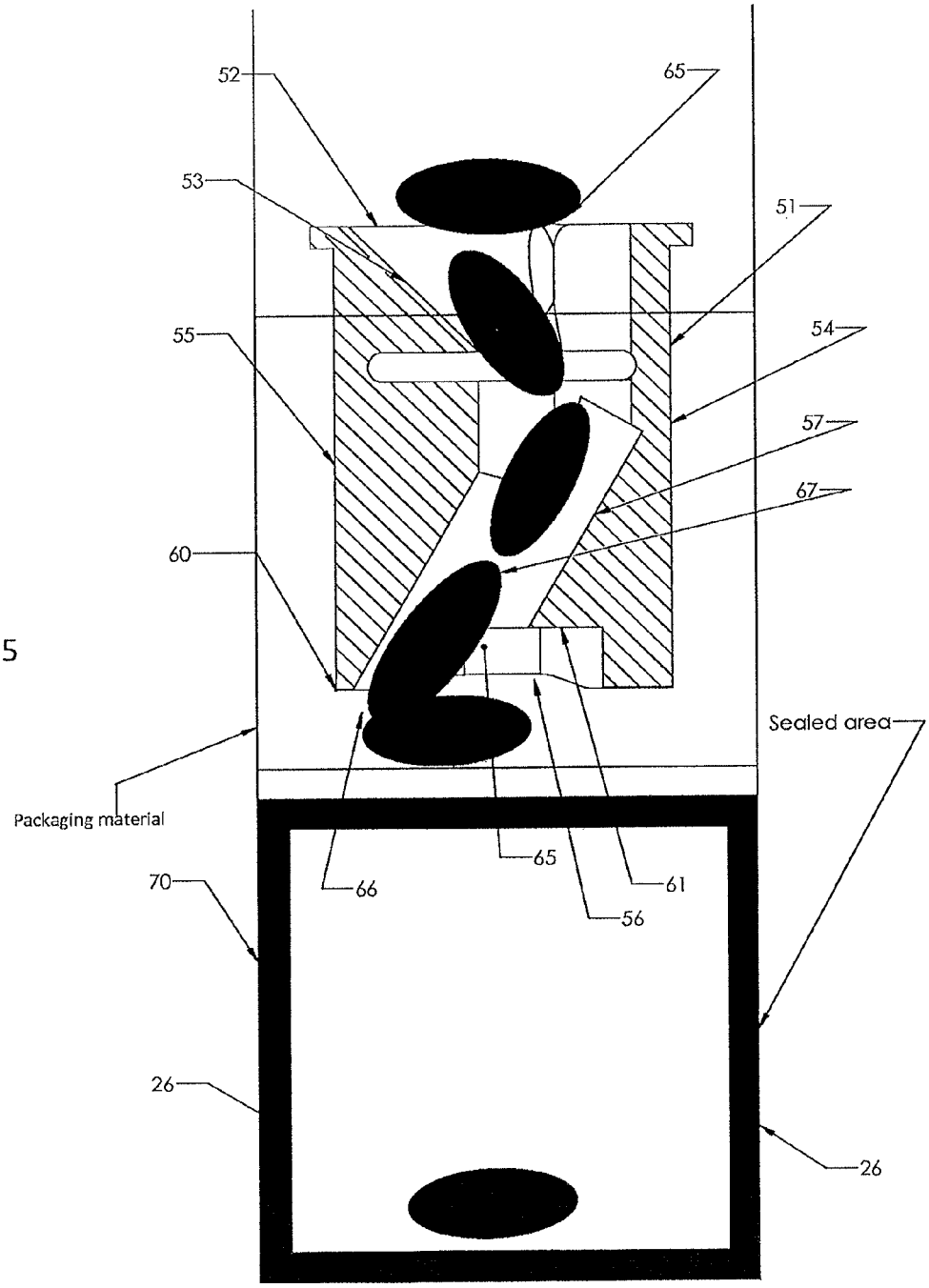
FIG. 5 is an illustration of how a pill travels through the pill guide of FIG. 4A.

It will be further understood that U-shaped jaw members 21 and 22 seal the film segments along three sides of a rectangle, the two vertical sides and a horizontal side as suggested by sealed portions 26 in FIG. 5. The horizontal seal portion acts both as a top sealed section for the individual bag or package formed below it and as a bottom sealed section for the individual package being formed above the horizontal seal. It should be visualized how the film is advanced, jaw members 21 and 22 close to form a horizontal sealed section which is the top of an individual pill package below the most recent horizontal sealed section and the bottom of the next package being formed. The package being formed likewise has a bottom section, but the top remains open to receive a pill falling through pill guide 50. Once a pill has been deposited in the unsealed package, the jaw members 21 and 22 close again providing a top seal for the individual package currently between the jaws. After the jaw members separate, the film 18 is then pulled downward a predefined distance such that the most recent sealed section becomes the bottom seal for the next individual pill package. While the width of the individual pill packages is controlled by the film width, the height or length (and therefore the "size" or volume) of the individual pill packages may be controlled by the length of film drawn past the jaws between closing cycles of the jaw members.

While FIG. 3B illustrates the position of pill guide 50 within packaging assembly 10, FIGS. 4A to 4E best illustrate the detailed structure of one embodiment of pill guide 50. Viewing FIG. 4A, pill guide 50 most generally comprises an elongated body 51 having an inlet aperture 52, an outlet aperture 56, and an angled passage between the inlet and outlet apertures. As most embodiments rely on gravity to move the pill through pill guide 50, inlet aperture 52 will normally be the upper end of the pill guide 50 and outlet aperture 56 the lower end (however, gravity feeding is not strictly necessary in all possible embodiments). Turning to the cross-section view in FIG. 4D, this embodiment of pill guide 50 has the internal passage beginning with an inclined or sloped surface 53 (the "inlet inclined surface") running from inlet 52 down into and toward the "front" portion 54 of body 51, then transitioning to a substantially vertical section 58, and finally reversing direction to an oppositely inclined surface 57 (the "outlet inclined surface") running toward the "rear" portion 55 of body 51. Obviously, "front" and "rear" portions of body 51 are somewhat arbitrary points of reference depending on how the pill guide 50 is positioned in the packaging assembly 10. For purposes of explaining the embodiments shown in the drawings, "front" is to the right and "rear" is to the left of the drawings (see for example FIG. 3B), but such designations should not be read as a limitation on the scope of invention claimed.

While the illustrated embodiments of pill guide 50 show body 51 having the inlet inclined surface 53, alternate embodiments could have no inlet inclined surface, e.g., the substantially vertical section 58 could extend all the way up to the opening of inlet 52. In many embodiments, the length of the outlet inclined surface is greater than the length of the inlet inclined surface. In certain embodiments, inlet inclined surface has a slope alpha of between about 25° and about 50° relative to a plane containing the inlet, and more preferably between about 30° and about 45°. Likewise, these embodiments may have a length of the inlet inclined surface of between about 16 mm and about 22 mm. In such embodiments, the outlet inclined surface may have a slope beta of between about 35° and about 65° relative to a plane containing said outlet, and more preferably between about 45° and about 60°, and most preferably about 55°. In these embodiments, wherein the length of the outlet inclined surface is between about 15 mm and about 30 mm, and more preferably, between 20 mm and 25 mm.

In the embodiments illustrated, the inlet 52 and outlet 56 are elongated and generally oval in shape. In certain embodiments, the inlet 52 has a long axis ("LA" in FIG. 4A) of between about 10 mm and about 50 mm and a short axis "SA" of between about 5 mm and about 20 mm. The outlet 56 has a long axis of between about 10 mm and about 50 mm and a short axis of between about 5 mm and about 20 mm. In many embodiments, the overall length of the pill guide body 51 is between about 25 mm and about 100 mm, and more preferably, between about 40 mm and about 60 mm. Another feature of the illustrated pill guide 50 is visual detection window or slot 63 formed in body 51. In the illustrated embodiments, visual detection window 62 is about 25 mm wide and extends through both sides of pill body 51. However, in other embodiments visual detection window 63 may only extend through one side of pill body 51. As explained in more detail below, the purpose of visual detection window 63 is to allow a sensor to detect a pill passing though pill guide 51.

FIG. 5 suggests how a pill 65 would travel through pill guide 50 upon entering inlet aperture 52. Pill 65 will be directed initially by inlet inclined surface 53 toward the front side 54 of guide body 51, and then transition toward the rear side 55 of guide body 51 as the pill encounters outlet inclined surface 57. FIG. 5 also suggests how the rear portion 60 of the outlet aperture 56 extends further downward than the front portion 61 of outlet aperture 56. In the embodiment of FIG. 5, rear portion 60 of the outlet is shown extending below front portion 61 of the outlet by a distance of "X." In certain embodiments, the distance X will range between about 3 mm and about 13 mm, with the illustrated embodiment having a distance X of about 6 mm. FIG. 5 also indicates how in the illustrated embodiment, the outlet aperture 56 is not necessarily centered in guide body 51, but has its rear portion 60 of the outlet aperture positioned more toward the rear side 55 of guide body 51 rather than the front side 54. As suggested by FIG. 5, the pill guide 50 acts to direct the pill such that it exits the outlet aperture 56 oriented with the leading edge 66 of the pill pointing toward one side of the pill package 70 and the trailing edge 67 of the pill leaning at an incline to an opposite side of the pill package. This orientation of the pill (especially for oblong pills) helps center the pill in the package for optimal packaging performance.

Returning to FIG. 2B, several additional features of the pill packaging system are illustrated. For example, a printer device 36 may be positioned such that a print head 37 is along the path of packaging film 18 to allow information about the drug being packaged to be printing on a section of film that will ultimately form the individual pill package containing the pill. In a preferred embodiment, the printer device 36 may be a Microcom Corporation Model #424M printer, but any conventional or future developed printer which can perform the functions described herein may be acceptable. While the content and form of information printed on a pill package can vary in different applications, one preferred embodiment will print a uniform product code (UPC) number and/or bar code on the individual pill package. Typically, the UPC will include a National Drug Code number, i.e., a 10-digit, 3-segment numeric identifier assigned to each medication listed under Section 510 of the US Federal Food, Drug, and Cosmetic Act and assigned by the US Food and Drug Administration (USFDA). Other information often printed on pill packages may include drug name, dosage, and expiration date. It will be understood that a system controller can direct the printer to print on the package any combination of information found in a pill information database associated with the system (which described in more detail below).

FIG. 2B also shows a bar code scanner 30 positioned within the housing of pill packaging assembly 10. It can be seen that bar code scanner 30 is oriented toward a back side of film 18, which is the same side on which printer device 36 will have printed product information on film 18. In one embodiment, bar code scanner 30 is a Honeywell MS4980. Turning to FIG. 2A, a first vision sensor 32 may be positioned above pill disk 4 in order to generate an image of the pill disk and pills positioned in the pill apertures. A second vision sensor 33 is positioned where it can view the individual pill packages after the pill packages have been fully sealed by the sealing jaws 20. It will be understood that vision sensor 33 is positioned where it views the package on the side formed of the transparent film 18. Although any conventional or future developed vision sensor could be utilized, one preferred embodiment employs the Cognex In-Sight 5403 for vision sensors 32 and 33. As seen in FIG. 1B, a sensor 45 is positioned to project a beam through the detection window 63 in pill guide 50 in order to allow sensor 45 to detect whether a pill passes through pill guide 50. In certain embodiments, sensor 45 is a beam sensor. One example of a beam sensor is a through beam sensor which has a light beam emitter on one side of pill guide window 63 and a beam detector on the other side of window 63. Another type of beam sensor is a reflected beam sensor which has the beam emitter and beam detector on the same side of the window 63. In either case, the beam detector registers when the light beam is momentarily broken by a pill passing the plane of the guide window (i.e., the plane passing through the window and being generally perpendicular to the vertical fall direction of the pill). Similarly, the beam detector senses a pill jam at the window when the beam remains broken. In one embodiment, the sensor is a Banner Engineering Corp. QS18ENSFPQ8. While the illustrated embodiment employs a laser or other light emitting sensor, alternative pill detecting sensors may include a reflecting, diffusing, or vision sensor, or any other conventional or future developed sensor which may detect a pill passing though pill guide 50.

Figure 7:
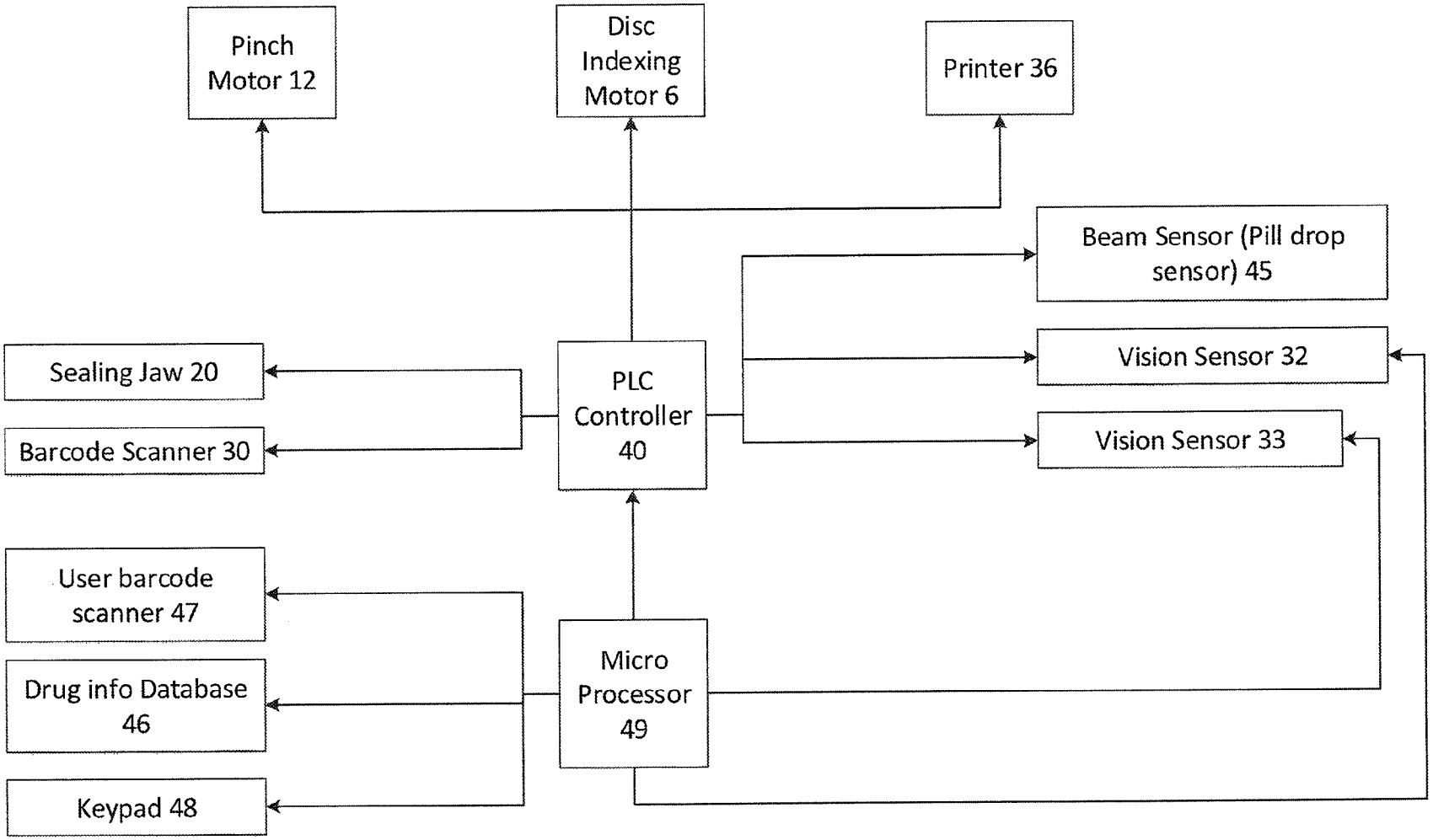
FIG. 7 is an electronic components diagram of one embodiment of the pill packaging system.

FIG. 7 generally illustrates how the electronic components described above will send information to a controller 40 and/or receive instructions from controller 40. Controller 40 will typically be a device such as Tri-PLC Model No. F2424, but may be any conventional or future developed control circuitry including microprocessors. Likewise, the functions performed by the electronics described herein may be implemented with a conventional software platform such as Tbasic ladder logic PLC program. FIG. 7 also indicates a user bar code scanner 47 which may be a scanner fixed to the packaging assembly housing or a hand-held scanner plugged into the system. One typical purpose of user bar code scanner 47 is to allow a user to scan product information (often in bar code format) on a pill stock bottle in connection with the user placing pills from the stock bottle on the tray 7 of the pill feeding assembly 3 in preparation for a packaging run. The product information from the stock bottle will be cross-referenced by the packaging system controller 40 to obtain other information in a system database in order to carry out various functions described below.

Several illustrated components require microprocessor functionality in order to operate and such components will communicate with PLC controller 40 via microprocessor 49. Thus, a keypad 48 (mechanical or touchscreen) communicates with controller 40 and services as an additional or alternative user input device. As suggested by FIG. 7, controller 40 will communicate (via microprocessor 49) with a database 46 which may include information required for the pill packaging system to function as described herein. Nonlimiting examples of some types of data stored in database 46 includes: a library of National Drug Code designations and drug information associated therewith; information on preferred package sizes to be associated with pills identified with an NDC designation (and corresponding bar code); a drug's generic name and trade name; the strength or dose per pill being packaged; form of the drug (pill, capsule, etc), the drug manufacturer; the manufacturer expiration date and lot number; control symbols; customer lot number; facility name; label preparer's name and date label is prepared; an image of the pill, description of the markings on the pill; controlled drug symbols, rules regarding package life, and any description or miscellaneous information the user may input into the database or print on the label (assuming sufficient space exists on the label).

Figure 6:
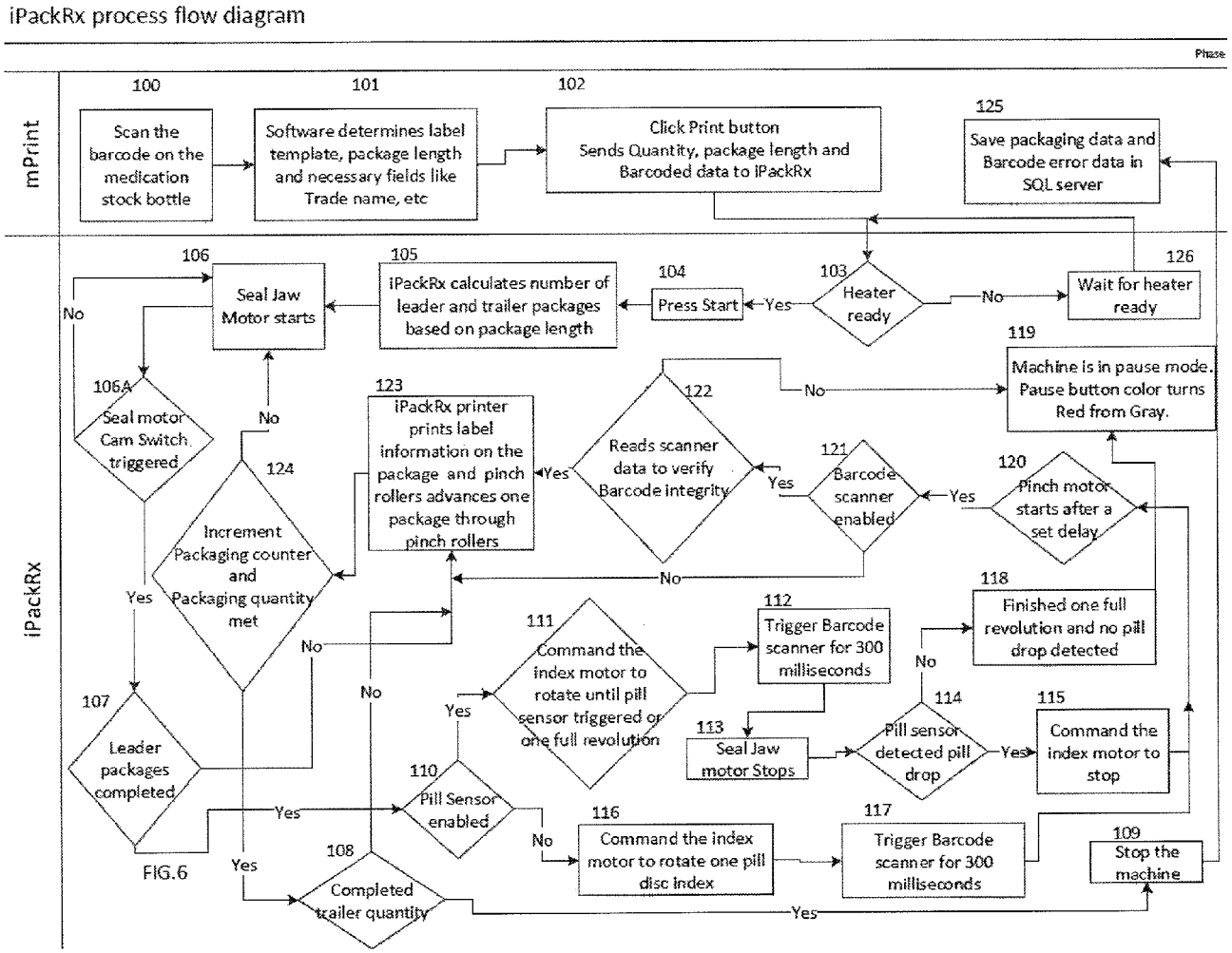
FIG. 6 is a flow chart illustrating one embodiment of how software would control the pill packaging system of the present invention.

While the programmable nature of controller 40 allows the pill packaging system to function in many different manners, one example of the system's functionality is described in reference to the flow chart in FIG. 6. In this embodiment, the user scans the bar code of the medication stock bottle to initiate the packaging process (step 100). Step 101 contemplates the software associating the drug identified in Step 100, via that drug's bar code, with drug information in the database, and then populating the template fields with information available in the database. The user may be required to enter other information (e.g., through keypad 48) such as the number of pills to be packaged. The system may also provide information regarding the size of individual pill packages in terms of the package height. In one example, the database 46 associates a package size with each pill type within the database. After the pill type is identified in step 101, the controller step 101 is able to determine the appropriate package size or height for use by controller 40 in operating pinch motors, sealing jaws, and other components who timing and operation depend on the package size. In one example, the bar code on the medication stock bottle is scanned by m:Print® bar code labeling software available from Pearson Medical Technologies, L.L.C. of Alexandria, La., and much of the information required to package the pill, including the height of package to be created, the label format template of the fields of information to be printed on the pill package, and the data to populate most of the fields of information on the package, may be available from cross-referencing the bar code information on the pill stock bottle with the system database. Once the correct package label template is selected, the package size determined, and the drug label information is completed, and then the user may send this information to the packager and packager printer by clicking the Print button (Step 102).

If the heater associated with sealing jaws 20 is ready (step 103), the user may engage the start button (step 104) to initiate the packaging run. The system software calculates the number of "leader packages" in step 105 based upon package height (i.e., the length of film between the sealing jaws and the printer defined in terms of a number of packages which cannot be properly labeled since this section of film is beyond the printer and is essentially wastage). In step 106, the seal jaw motor starts actuating the seal jaw cam which pushes the left U-shaped seal jaw 21 to move toward the right U-shaped seal jaw 22 until the seal jaw cam reaches its maximum extension at which point the two packaging films are pressed together and make a seal along the path of the U-shaped seal jaws to create a single package. In step 106*a* the motion of the seal motor cam triggers the seal motor cam switch which causes the system software to check if the system has cycled sufficient times to complete the production of the calculated number of leader packages in step 107. If not, then the packager printer and pinch rollers cycle again in step 123. If the calculated number of leader packages have been completed in step 107, and if the pill sensor has been activated in step 110, then the index motor is activated in step 111 causing the pill disk to advance until the earlier of (a) the pill sensor detecting a pill dropping through the pill guide or (b) until the index motor makes one complete revolution in step 118 (and in which case the packages pauses in step 119), the bar code scanner is triggered in step 112, and the seal jaw motor stops after a delay in step 113. If the pill drop sensor detects a pill dropping through the pill guide in step 114, then the controller commands the index motor to stop in step 115.

If after the calculated number of leader packages have been completed in step 107, and if the pill sensor has not been activated in step 110, then the controller commands the index motor to advance in pill disk index in step 116 and to trigger the bar code scanner in step 117.

After either step 115 or 117, the controller commands the pinch motor to start after a preset delay in step 120 and if the bar code scanner has been enabled in step 121, then the bar code scanner reads the printed package to verify the integrity of the printed bar code in step 122. If the bar code scanner cannot read the bar code in step 122, then the packager is paused in step 119. If the bar code is successfully read and verified in step 122, then the packaging cycle is begun again in step 123 by the packager printer printing a new package label and the pinch rollers advancing one package height.

If the bar code scanner has not been enabled in step 121, then after step 120, the packaging cycle is begun again in step 123 by the packager printer printing a new package label and the pinch rollers advancing one package height.

The controller operating the hardware described herein may perform many functions independently of or in conjunction with the steps outlined in FIG. 6. For example, when camera 32 is positioned to view the pill disk as shown in FIG. 2A, the controller may analyze images from the camera and using visual analysis software, determine whether more than one pill is positioned in a pill slot on the pill disk. Likewise, the pill packaging system may include a database of pill vision-related information corresponding to each pill type expected to be packaged. Examples of vision-related information includes actual images of the pill type, dimensions of the pill, surface area of the pill, eccentricity of the pill, markings on the pill, color of the pill, shape of the pill, and calculated possible angles of the pill image from different perspectives, and various simultaneous combinations of the above information. The controller may compare at least one image of the actual pill being packaged which has been taken by either camera 33 or 32 or both (preferably at least by camera 33 since that is the image of the pill in the actual package) to vision-related information in the database (e.g., an image of the pill type expected to be in the package). Then the controller may verify that the pill actually being packaged corresponds to the pill type from the database which is expected to be in the package.

Another function is suggested by the bar code scanner 30 being positioned as in FIG. 2A to read the bar code on the pill package after the pill package has been formed by the sealing jaws. Certain embodiments of the pill packaging system may include a marker device (such as an ink jet printer nozzle) which is capable of marking a pill package when the bar code scanner cannot read the bar code on the pill package. For example, the marking device might apply a dye, paint, or ink to the package in the form of a simple ink blot or "x." In this embodiment, when the controller detects an unreadable bar code, the controller may cease operation of the packaging system and generates an error message for the operator specifying the packages with non-readable bar codes or it may simply inform the user that bar codes on certain packages were not properly read or verified.

Although the system of the present invention has been described as a "pill" packaging system, it will be understood that its features could apply to a wide variety of small articles, including as non-limiting examples, hardware items (specialty screws or fasteners), electronic components (small chips, LED's, or other discrete electronics), dental components, or food products e.g., hard candy). Those skilled in the art will recognize many modifications and variations to the above described embodiments and all such modifications and variations are intended to come within the scope of the following claims.

We claim:

1. A pill packaging system comprising:

a. a pill feeding assembly;

b. a pill packaging assembly positioning individual pill packages to receive a pill;

c. a pill guide positioned between the feeding assembly and packaging assembly, the pill guide comprising:

i. a body having an inlet aperture in an upper end of the body and an elongated outlet aperture on a lower end of the body, the outlet aperture having a front and rear portion;

ii. an outlet inclined surface sloping toward the rear of the body and transitioning to the outlet aperture; and iii. the rear portion of the outlet aperture extending further downward than the front portion of the outlet aperture, whereby a pill traveling through the pill guide exits the outlet aperture oriented such that a leading edge of the pill points toward one side of the pill package and the trailing edge of the pill is inclined toward an opposite side of the pill package.

2. The pill packaging system according to claim 1, wherein the outlet inclined surface is positioned more to the rear portion of the outlet aperture than the front portion.

3. The pill packaging system according to claim 1, wherein the pill guide body includes an inlet inclined surface sloping from the inlet aperture toward the front portion of the body.

4. The pill packaging system according to claim 3, wherein the inlet inclined surface has a slope of between about 35° and about 55° relative to a plane containing the inlet aperture.

5. The pill packaging system according to claim 3, wherein the length of the outlet inclined surface is between about 22 mm and about 28 mm and the length of the inlet inclined surface is between about 16 mm and about 22 mm.

6. The pill packaging system according to claim 1, wherein the outlet inclined surface has a slope of between about 40° and about 75° relative to a plane containing the outlet aperture.

7. The pill packaging system according to claim 1, wherein a visual detection window is formed in the pill guide body.

8. The pill packaging system according to claim 1, wherein the system further includes a printer to print label information on a pill package formed by the system.

9. The pill packaging system according to claim 8, wherein the pill packaging assembly includes a bar code scanner positioned to read a bar code on the pill package after the pill package has been formed by a set of sealing jaws.

* * * * *